US005192066A

United States Patent [19]

Steinhilber

[11] Patent Number: 5,192,066

[45] Date of Patent: Mar. 9, 1993

[54] DEVICE FOR TRANSPORTING SHEETS IN OFFICE MACHINES

[76] Inventor: Helmut Steinhilber, Sonnenbergstrasse 40, CH-6052 Hergiswil, Switzerland

[21] Appl. No.: 751,132

[22] Filed: Aug. 28, 1991

[30] Foreign Application Priority Data

Oct. 19, 1990 [DE] Fed. Rep. of Germany ..... 4033237

[51] Int. Cl.[5] ..... B65H 3/44; B65H 5/02; B65H 39/10

[52] U.S. Cl. ..... 271/9; 271/10; 271/198; 271/275; 271/296; 198/721

[58] Field of Search ..... 271/10, 198, 264, 272, 271/275, 1, 6, 7, 9, 296, 299; 198/721

[56] References Cited

U.S. PATENT DOCUMENTS

| | | | |
|---|---|---|---|
| 2,551,598 | 5/1951 | Hall . | |
| 3,372,922 | 3/1968 | Snellman et al. | 271/296 |
| 3,604,316 | 9/1971 | Labombarde | 271/264 X |
| 3,869,117 | 3/1975 | Yoshimura | 271/270 |
| 4,043,551 | 8/1977 | Morrison et al. | 271/270 X |
| 4,364,554 | 12/1982 | Akers | 271/272 |
| 4,842,264 | 6/1989 | Kosaka et al. | 271/296 X |
| 4,948,115 | 8/1990 | Burger . | |

FOREIGN PATENT DOCUMENTS

| | | | |
|---|---|---|---|
| 523673 | 4/1931 | Fed. Rep. of Germany | 271/264 |
| 457837 | 9/1913 | France | 271/198 |
| 2635 | 1/1986 | Japan | 271/264 |
| 117148 | 5/1989 | Japan | 271/270 |
| 2223039 | 3/1990 | United Kingdom | 271/264 |

*Primary Examiner*—Robert P. Olszewski
*Assistant Examiner*—Boris Milef
*Attorney, Agent, or Firm*—Mason, Fenwick & Lawrence

[57] ABSTRACT

A device for transporting individual sheets of a sheet-form recording medium in office machines comprises an endless circulating conveyor belt for transporting the sheets. A pressure device holds sheets positively against the conveyor belt, and has a flat body parallel to and spaced from the conveyor belt; the body has thin, soft elastic pressure elements which press sheets against the conveyor belt.

9 Claims, 3 Drawing Sheets

DEVICE FOR TRANSPORTING SHEETS IN OFFICE MACHINES

FIELD OF THE INVENTION

The invention relates to a device for transporting individual sheets of a sheet-form recording medium in office machines according to the preamble of claim 1.

BACKGROUND OF THE INVENTION

In a variety of office machines, individual sheets of sheet-form recording media must be transported. Transportation can take place for example from one or more magazines that receive the sheets in stack form, to a processing station, for example a printer or a copier. Similarly, transportation can take place from the processing station to a storage compartment or a plurality of storage compartments in a sorter. It is known that an endlessly circulating conveyor belt can be used for such transport, said belt engaging the sheets. For positive engagement it is necessary to press the sheets against the conveyor belt with light pressure. Various pressure devices for this purpose are known. A second endlessly circulating pressure belt can be provided parallel to the conveyor belt, with the sheets being gripped between the conveyor belt and the pressure belt. It is also known that freely turning rollers can be provided abutting the conveyor belt, with the sheets being guided between the rollers and the conveyor. Finally, it is known that a vacuum chamber can be disposed on the back of the conveyor belt, so that the sheets are sucked against the conveyor belt by the vacuum. All of these known devices are costly in their construction.

The goal of the invention is to provide a device for transporting individual sheets outset in which the pressure device is of simple and inexpensive construction.

SUMMARY OF THE INVENTION

According to the invention, a flat body of the pressure device is located opposite the surface of the conveyor belt which receives the sheets, said body pressing said sheets against said conveyor belt by means of thin, soft, elastic pressure elements. The distance between the body of the pressure device and the conveyor belt and the length of the pressure elements are provided so that the conveyor belt does not come in contact with the body of the pressure device, which would result in high frictional resistance for the conveyor belt and the sheets being transported, and that the pressure elements are always in contact with the conveyor belt even when the width of the gap fluctuates, for example due to a sag in the conveyor belt, so that the sheets are reliably held against the conveyor belt. The elasticity of the pressure elements is such that they hold the sheets against the conveyor belt under light pressure, Yet flex sufficiently as they press against the conveyor belt and the sheets passing through so that they do not generate an resistance that impedes transport. In particular, the pressure elements must not present a frictional resistance to the sheets being transported which is greater than the force carrying the sheets along between the sheet and the conveyor belt.

The body of the pressure device is preferably constructed to be fixed, permitting an especially simple construction. The body can be a rigid plate or a fixed stretched belt. If only one magazine is provided from which the sheets are to be transported, or only one storage compartment is provided into which the sheets are to be transported, the body of the pressure device can be a continuous surface so that the sheets enter at one end of the body, between the latter and the conveyor belt, and emerge at the other end of the body. If sheets are to be collected by the conveyor from a plurality of magazines arranged sequentially or are to be dispensed into a plurality of storage compartments arranged sequentially, the body of the pressure device can be provided with slots extending transversely to the direction of transport, said slots being associated with the respective magazines and/or storage compartments, and through which slots the sheets can escape from the magazines into the space between the conveyor belt and the body of the pressure device, or can escape from said space.

If a movable transfer unit is provided optionally to remove sheets under control from one of several magazines or optionally to dispense them into one of a plurality of storage compartments, the body of the pressure device can also be made in the form of a flexible belt, one end of which is mounted to the transfer unit and having a spring force applied to its other end, said force both keeping the belt tensioned and allowing the belt to move together with the transfer unit. In this case, the flexible belt moves together with the transfer unit so that it abuts the conveyor belt only in the area of the transport path of the sheets, which changes with the position of the transfer unit.

The pressure elements can have a wide variety of forms, provided only that the conditions regarding their length and elastic properties are met. The pressure elements can consist for example especially of bristles or thin strips, preferably made of plastic. The required conditions can be optimally met by the selection of the plastic material of the pressure elements. In particular, the cross section of the pressure elements in the vicinity of their free ends that abut the conveyor belt can be reduced in such manner that their resistance to the continuous passage of sheets is minimal.

The density with which the pressure elements are arranged o the body that reliable pressure with the lowest possible resistance is achieved. Too dense an arrangement increases the resistance. On the other hand, the mutual spacing of the pressure elements must be less than the linear dimensions of the sheet, preferably much smaller than these dimensions, so that the sheet will be reliably held against the conveyor belt over its entire surface. The pressure elements can be arranged in a uniformly distributed pattern on the body. It is also possible to equip those strips on the body that run in the transport direction with pressure elements, the transverse spacing of these strips of course being smaller that the transverse dimensions of the sheets.

The pressure device according to the invention can be used with conveyor belts that transport vertically or horizontally. In the case of horizontally transporting conveyor belts, the pressure device can hold the sheets against the upper run of the conveyor belt or, by pressing from below, can hold said sheets against the lower run of the conveyor belt.

DESCRIPTION OF THE PREFERRED EMBODIMENTS

Figure 1:
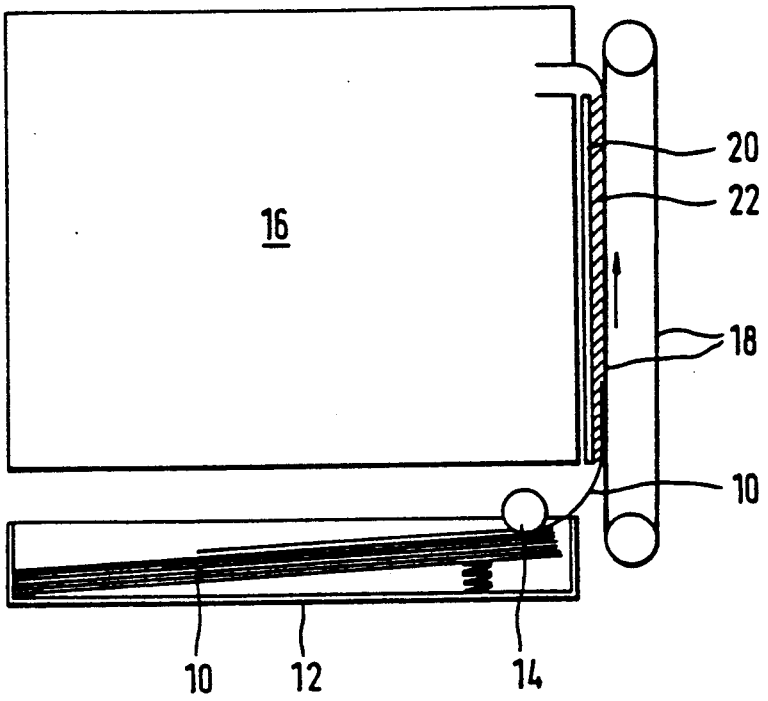
FIG. 1 shows a schematic side view of a first embodiment of the device for transporting individual sheets.

In the embodiment shown in FIG. 1, sheets 10 of a sheet-form recording medium are stored stacked in a magazine 12 designed as a cassette. Sheet stack 10 is forced in a known manner by means of a spring-loaded bottom against a feed roller 14 that pulls sheets 10 individually off the stack.

In order to feed individual sheets 10 to the processing station of an office machine 16, for example a printer or a copier, an endlessly circulating powered conveyor belt 18 is provided. Conveyor belt 18 consists of a belt or a plurality of belts running parallel next to one another, made of an adhesive plastic or rubber material. Sheets 10 that abut conveyor belt 18 are positively engaged by the adhesive property of conveyor belt 18.

In the embodiment shown in FIG. 1, magazine 12 is located beneath office machine 16 and sheets 10 are conveyed upward by vertically running conveyor belt 18 to a feed slot in office machine 16. In order to pres sheets 10 against the upwardly running carrier run of conveyor belt 18, a pressure device with a flat body in the form of a plate 20 made of a lightweight plastic is provided. Plate 20 is equipped with pressure elements in the form of bristles 22 made of plastic. Plate 20 has a width matching the width of conveyor belt 18. In the transport direction, plate 20 extends over the entire length of the transport path of sheets 10. Plate 20 is mounted in a fixed position parallel to the upwardly running carrier run of conveyor belt 18, with plate 20 located a short distance, 3 to 10 mm for example, from conveyor belt 18. Bristles 22 are inserted into plate 20 or are preferably also shaped from plastic on plate 20. The length of bristles 22 is somewhat greater (2 to 3 mm, for example) than the distance between plate 20 and the carrier run of conveyor belt 18. Bristles 22 therefore have their ends abutting conveyor belt 18. Bristles 22, at least at their ends, have a cross section which is so thin that, in conjunction with the elastic properties of its material, it makes them soft and elastic, at least in the area that abuts circulating conveyor belt 18, and contact conveyor belt 18 only with light pressure.

Plate 20 is uniformly provided with bristles 22 over its entire surface facing conveyor belt 18, said bristles being mutually spaced at a relatively long distance from one another, but said spacing nevertheless being short relative to the lengthwise and transverse dimensions of sheets 10.

Sheets 10 pulled off individually from magazine 12 by feed roller 14 are pushed against the lower edge of plate 20 between the latter and the upwardly running carrier run of conveyor belt 18. Bristles 22 of plate 20 thus press sheets 10 gently against conveyor belt 18 so that the latter positively engages said sheets 10. Sheet 10 emerges at the upper edge of plate 20 between plate 20 and conveyor belt 18 and is deflected into the feed slot of office machine 16.

Because the length of bristles 22 is greater than the distance between plate 20 and conveyor belt 18, bristles 22 always have their ends abutting conveyor belt 18, even when the distance between plate 20 and conveyor belt 18 changes slightly as a result of flapping or sagging of conveyor belt 18. Sheets 10 are therefore always held reliably with their entire surfaces abutting conveyor belt 18. The soft elastic properties of bristles 22 ensure that bristles 22 do not exert any significant braking action on conveyor belt 18. In particular, the resistance which bristles 22 offer to sheets 10 being transported is much less than the force of friction between sheets 10 and conveyor belt 18 that entrains sheets 10.

The pressure elements, instead of having the shape of bristles 22, can also have the shape of thin strips molded on plate 20 and projecting therefrom toward conveyor belt 18. The width of the strips extends crosswise with respect to the transport direction.

The length of the strips corresponds to the length of bristles 22, but the strips have a limited thickness in the transport direction and, especially in their end areas, possess soft elastic properties like those described above for bristles 22.

Figure 2:
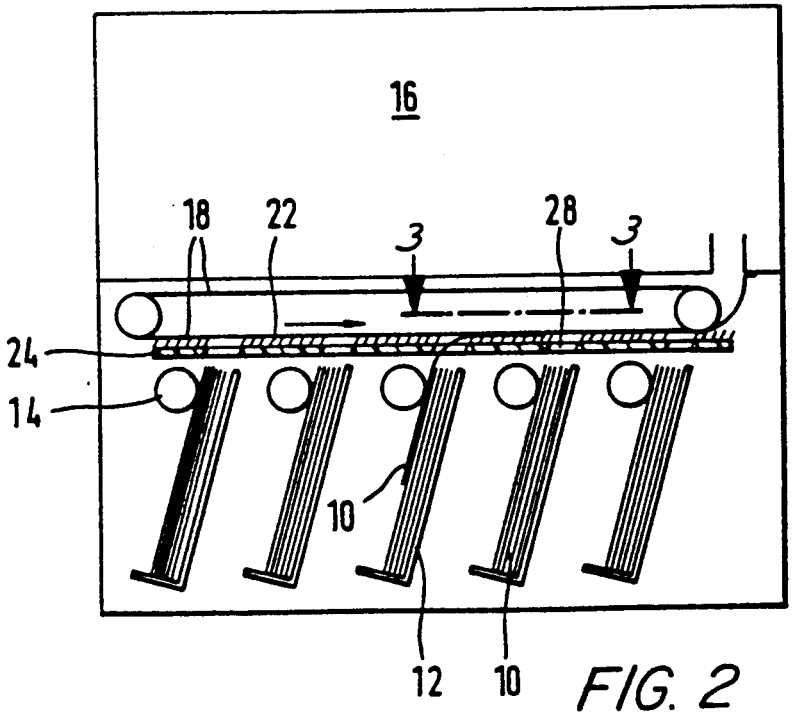
FIG. 2 is a schematic side view of a second embodiment.

FIG. 2 shows a second embodiment of the transport device according t the invention.

A plurality of magazines 12 is provided, each of which has a stack of sheets 10 standing on end. Each magazine 12 has a feed roller 14 associated therewith, said feed rollers 14 being optionally controllable to feed one sheet of a certain kind from a selected magazine 12 to office machine 16.

Figure 3:
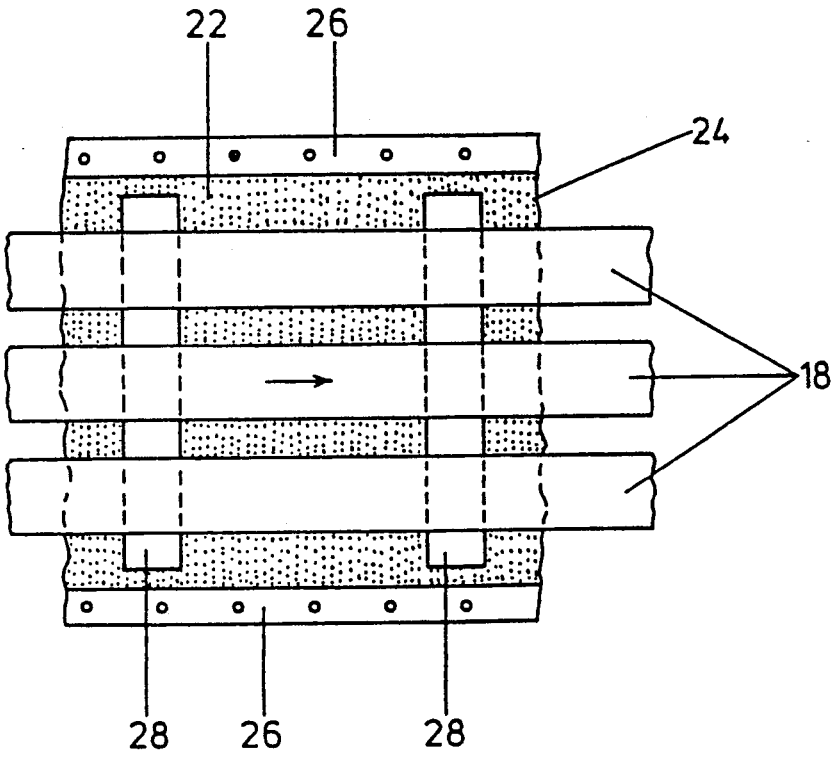
FIG. 3 is a partial top view along line 3—3 in FIG. 2.

Conveyor belt 18 runs horizontally above sequentially arranged magazines 12. Conveyor belt 18 extends over all magazines 12 up to the feed slot of office machine 16. The flat body of the pressure device is located between the upper edge of magazine 12 and the lower carrier run of conveying belt 18. The flat body in this embodiment consists of a belt 24 extending across the entire length of the lower carrier run of conveyor belt 18. Belt 24, as shown in FIG. 3, is mounted so that it is fixed and stretched tightly by tensioning strips 26 provided at its edges. The top of belt 24 facing conveyor belt 18 is equipped with bristles 22, said bristles, in the manner described above, by virtue of their soft elastic properties and their length and by virtue of the distance between belt 24 and conveyor belt 18, abut the lower, carrier run of conveyor belt 18 from below.

In order to permit sheets 10 fed from the various magazines 12 to enter between belt 24 and conveyor belt 18, belt 24 has a slot 28 above each magazine 12, said slot extending transversely to the transport direction over the width of magazine 12.

When feed roller 14 of selected magazine 12 is controlled, it feeds uppermost sheet 10 off the stack and upward out of this magazine. Sheet 10 passes through slot 28 in belt 24 located above this magazine 12 and passes between the lower, carrier run of conveyor belt 18 and bristles 22 provided on belt 24. Bristles 22 of belt 24 press sheet 10 from below against conveyor belt 18 and cause said sheet to be engaged positively by said belt and to be discharged from the end of conveyor belt 18 into office machine 16. Bristles 22 hold sheet 10 against conveyor belt 18 over its entire area to ensure a reliable positive connection between sheet 10 and conveyor belt 18. The dimensions of slots 28 is much less in the transport direction than the length of sheets 10, so that sheets 10 are reliably supported even when crossing over slots 28 of successive magazines 12. A feed ramp can also be provided at the edge of slot 28 that lies in the transport direction, said ramp facilitating the entry of sheets 10, fed from below out of magazine 12, between belt 24 and conveyor belt 18. A feed ramp of this kind also guarantees that the leading edge of sheet 10, on crossing the next slot 28 in the transport direction, is not deflected downward out of slot 28.

In this embodiment, the length of bristles 22 also especially favors compensation of any differences in spacing between belt 24 and the lower run of conveyor belt 18 resulting from sag in belt 24.

Figure 4:
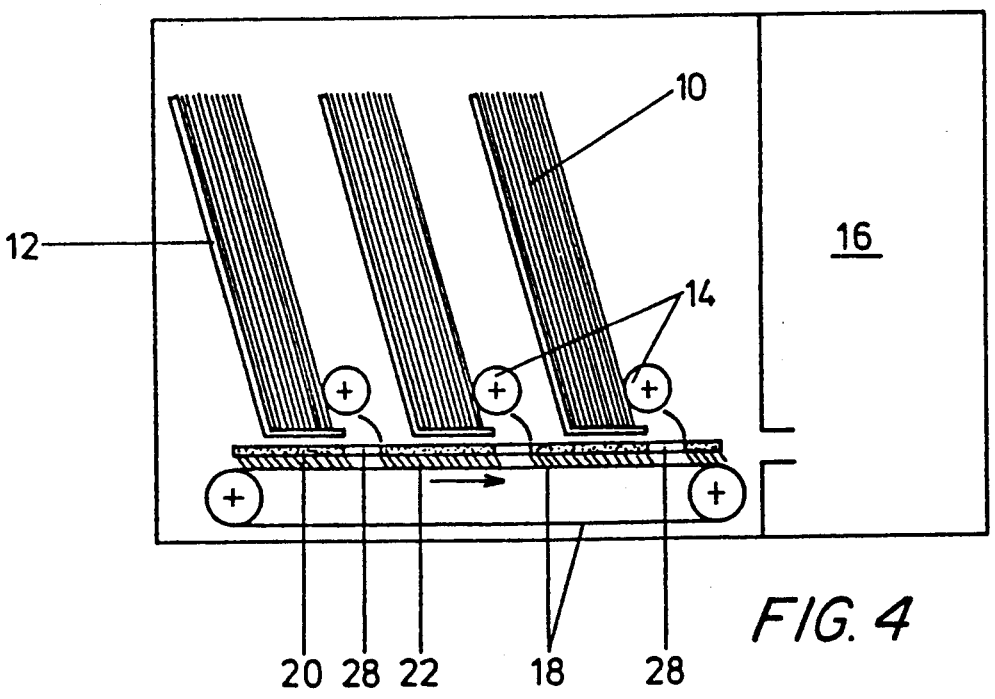
FIG. 4 is a schematic side view of a third embodiment.

FIG. 4 shows a third embodiment.

In this embodiment, a plurality of magazines 12 is provided, each of which has a stack of sheets 10 standing on end; the magazines 12 are arranged sequentially above horizontal conveyor belt 18, each magazine having a feed roller 14. Sheets 10 fed by feed roller 14 from a selected magazine 12 reach the upper, carrier run of conveyor belt 18 and ar transported by the latter to office machine 16.

In order to keep sheets 10 resting on conveyor belt 18, the flat body of the pressure device is located at a distance above the upper run of conveyor belt 18. In this embodiment, this flat body consists of stiff plate 20 provided on its underside with bristles 22, as described with reference to the embodiment in FIG. 1. In order to be able to feed sheets 10 out of the different magazines 1 between plate 20 provided with bristles 22 and the upper, carrier run of conveyor belt 18, plate 20 has a slot 28 associated with each magazine, as described in conjunction with the embodiment shown in FIG. 2.

Figure 5:
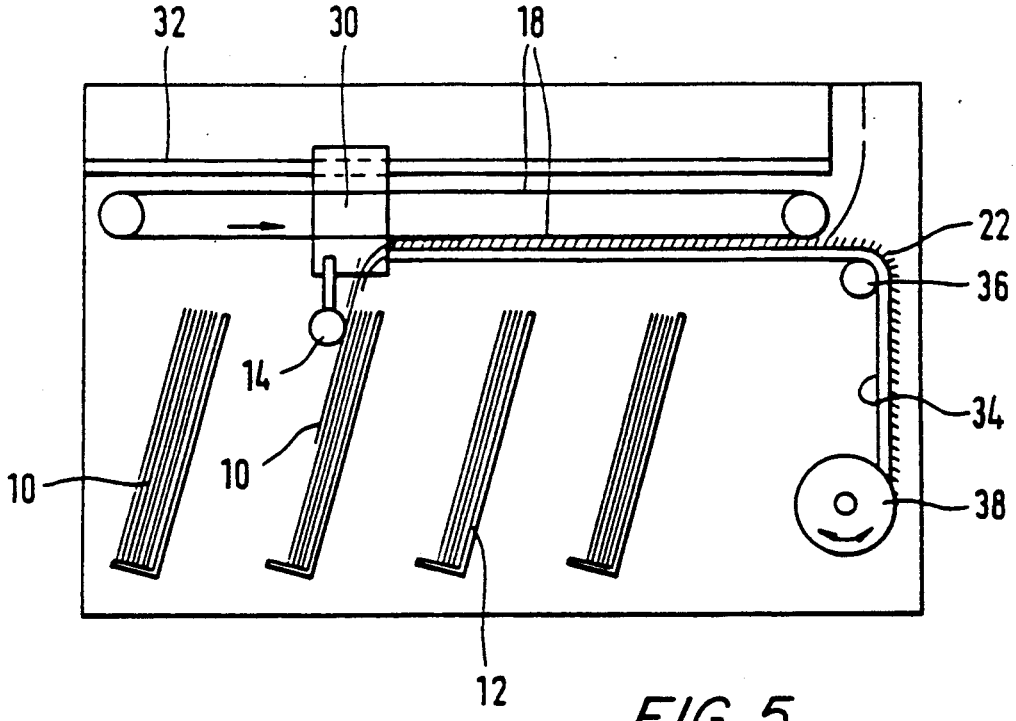
FIG. 5 is a schematic side view of a fourth embodiment.

FIG. 5 shows a fourth embodiment.

This embodiment corresponds to the embodiment in FIG. 2 to the extent that a plurality of magazines 12 with stacks of sheets 10 resting on their ends are located beneath horizontally travelling conveyor belt 18. In order to transport sheets 10 out of selected magazines 12 upward to conveyor belt 18, however, only a single feed roller 14 is provided in the embodiment shown in FIG. 5. This feed roller 14 is associated with a transfer unit 30 which fits over conveyor belt 18 in the manner of a bridge and is movable on guide rails 32 along conveyor belt 18 above magazines 12. The transfer unit 30 is moved under control over selected magazine 12, whereupon feed roller 14 is swung downward against the stack of sheets 10 in this magazine 12, in other words into the position shown in FIG. 5, in order then to feed the uppermost sheet 10 in the stack from magazine 12.

In this embodiment, the flat body of the pressure device consists of a flexible belt 34 provided in the manner described above with bristles 22 on its upper surface facing the lower, carrier run of conveyor belt 18. One end of belt 34 is fastened to transfer unit 30. Belt 34 runs parallel to the lower run of conveyor belt 18 and is guided downward at its end around a reversing roller 36 and is then taken up on a drum 38 under spring tension.

If the transfer unit is moved to the left to reach a selected magazine 12 in FIG. 5, transfer unit 30 pulls belt 34 away from drum 38 against spring tension. If transfer unit 30 is moved to the right, the excess length of belt 34 is taken up on drum 38. The spring tension on drum 38 ensures that belt 34 is always kept stretched tight and is tensioned between transfer unit 30 and reversing roller 36 parallel to the lower, carrier run of conveyor belt 18 at the specified distance therefrom.

Sheet 10 fed by transfer unit 30 from selected magazine 12 passes between the end of belt 34 and the lower run of conveyor belt 18 and is held by belt 34 for the entire transport distance until sheet 10 is dispensed from conveyor belt 18. In this embodiment, even when there are several magazines 12, no slots 28 are required in belt 34.

Figure 6:
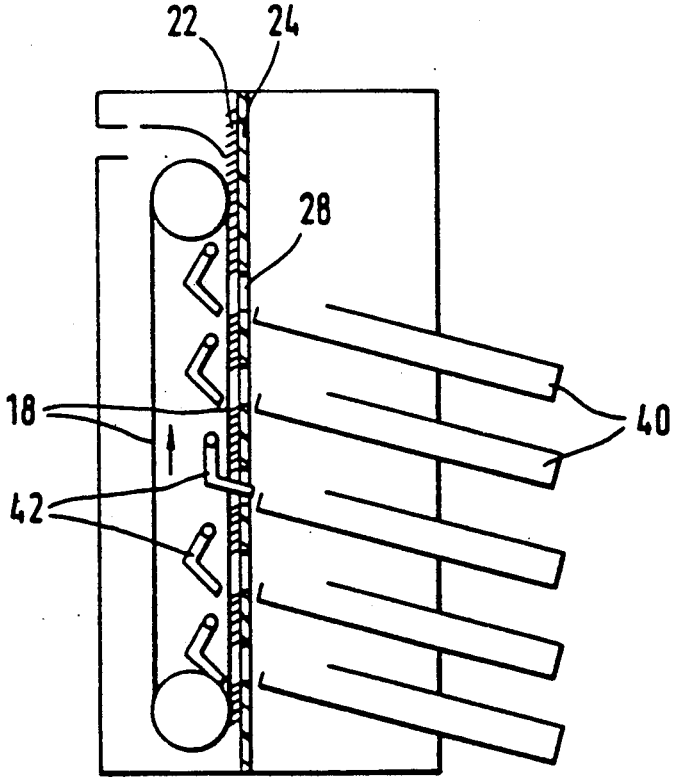
FIG. 6 is a schematic side view of a fifth embodiment.

FIG. 6 shows fifth embodiment.

In this embodiment the transport device is used in conjunction with a sorter. Sheets coming from an office machine, for example a printer or a copier, are guided upward between the downward moving carrier run of vertically circulating endless conveyor belt 18 and the flat body of the pressure device. Conveyor belt 18 runs along in front of storage compartments 40 arranged vertically above each other. Each storage compartment 40 is associated with a switch 42, which is pivotable behind the downwardly travelling run of conveyor belt 18, out of the transport path of sheets 10. Under control, switches 42 can be swung into an operating position in which they engage between the belts of conveyor belt 18 in the path of sheets 10 to deflect the latter into respective storage compartment 40. This position is shown in FIG. 6 for middle switch 42.

The flat body of the pressure device in this embodiment consists of a tightly stretched belt 24 having, on the side facing conveyor belt 18, bristles 22 as described in conjunction with the embodiments in FIGS. 2 and 3. Belt 24, in front of each storage compartment 40, has a slot 28 running transversely to the direction of transport, through which slot sheets 10 deflected by switch 42 can pass and be deflected into corresponding storage compartment 40.

It is evident from the above embodiments that the pressure device according to the invention may be used for vertically and horizontally running conveyor belts, with the carrier run being the upwardly travelling or downwardly travelling run of a vertical conveyor belt and likewise the upper or lower run of a horizontally travelling conveyor belt. The pressure device can then be set in all cases for feeding sheets from one or more magazines and for storing sheets in one or more storage compartments. Similarly, the pressure device can be used for all other transport processes involving sheets using circulating conveyor belts. The special needs of the application determine the form of the pressure device and the pressure elements.

I claim:

1. A device for transporting individual sheets of a sheet-form recording medium in office machines comprising:

an endlessly circulating conveyor belt for positively engaging the sheets and comprising a carrier run, a pressure device for holding the sheets in positive contact with the conveyor belt, the pressure device comprising at least one flat body parallel to the surface of the carrier run of the conveyor belt, said flat body being located at a fixed distance from said conveyor belt said body comprising thin, soft elastic mutually spaced pressure elements directed against said conveyor belt, the length of said pressure elements being greater than the distance between said flat body and said conveyor belt, and the mutual spacing of said elements being less than the linear dimensions of the sheets being transported, a transport unit movable substantially parallel to said carrier run of said conveyor belt in front of magazines or storage compartments, said flat body of said pressure device comprising at least a portion of a flexible belt having first and second ends, one said end of said flexible belt being attached to said transfer unit, a spring, said flexible belt having a second end attached to said spring for keeping said flexible belt under tension;

whereby said transfer unit may feed sheets out of a plurality of magazines or dispense sheets into a plurality of storage compartments disposed along said conveyor belt by movement of said transfer unit along said conveyor belt in from of said magazines or storage compartments.

2. A device according to claim 1, and further comprising a located adjacent an end of the carrier run of the conveyor belt, said flexible belt being guided over said roller.

3. A device according to claim 1, said spring being a part of a spring-loaded drum, said second end of said flexible belt being wound on said spring-loaded drum.

4. A device according to claim 1, said pressure elements being bristles.

5. A device according to claim 4, said bristles being made of plastic.

6. A device according to claim 1, said pressure elements being made of plastic.

7. A device according to claim 1, the width of the flexible belt being at least equal to the width of said conveyor belt.

8. A device according to claim 1, said pressure elements being uniformly distributed over the entire width of said conveyor belt on said flexible belt.

9. A device according to claim 1, said pressure elements being arranged in strips on said flexible belt, said strips running in the lengthwise direction of said conveyor belt and having a transverse spacing less than the transverse dimension of a transported sheet.

* * * * *